US005802723A

United States Patent [19]

Haggar

[11] Patent Number: 5,802,723

[45] Date of Patent: Sep. 8, 1998

[54] ADJUSTABLE BOW KNIFE

[76] Inventor: Carl Haggar, P.O. Box 65, Hwy. 2 West, East Glacier Park, Mont. 59434-0065

[21] Appl. No.: 802,412

[22] Filed: Feb. 18, 1997

[51] Int. Cl.[6] ..... B26B 3/03

[52] U.S. Cl. ..... 30/283; 30/293

[58] Field of Search ..... 30/283, 282, 284, 30/289, 293; D7/650

[56] References Cited

U.S. PATENT DOCUMENTS

| | | | |
|---|---|---|---|
| 63,236 | 3/1867 | Force | 30/283 |
| D. 136,182 | 8/1943 | Oliver | D7/650 |
| D. 325,326 | 4/1992 | Parven | D7/650 |
| 602,758 | 4/1898 | Landers | 30/283 |
| 2,326,563 | 8/1943 | Rezos | 30/283 |
| 2,856,688 | 10/1958 | Kopel | 30/283 |
| 3,095,646 | 7/1963 | Szekely | 30/283 |
| 3,103,745 | 9/1963 | Taylor | 30/283 |
| 3,222,784 | 12/1965 | Phillips et al. | 30/293 |
| 3,736,662 | 6/1973 | Hartmann | 30/283 |
| 4,054,994 | 10/1977 | Grossman | 30/296 |
| 4,964,323 | 10/1990 | Fortney | 83/167 |
| 5,095,790 | 3/1992 | Pattillo | 83/13 |
| 5,115,704 | 5/1992 | Hyman | 83/467.1 |
| 5,575,070 | 11/1996 | Anderson | 30/283 |

*Primary Examiner*—Hwei-Siu Payer
*Attorney, Agent, or Firm*—Keith S. Bergman

[57] ABSTRACT

A bow type knife provides an adjustment bar between the back and the blade to adjustably determine thickness of sliced material. The adjustment bar is pivotally mounted on two spaced support arms that are pivotally carried in angulated parallel orientation by the back to allow motion of the adjustment bar parallel to the back. An end portion of the adjustment bar proximal to the bow handle carries an adjustment screw that extends in angulated orientation through the bow body and through a nut carried in that body and projecting therethrough for manual manipulation to adjustably position the adjustment bar relative to the knife blade.

4 Claims, 2 Drawing Sheets

ADJUSTABLE BOW KNIFE

RELATED APPLICATIONS

There are no applications related hereto heretofore filed in this or any foreign country.

BACKGROUND OF INVENTION

1. Field of Invention

This invention relates generally to bow knives, and more particularly to such a knife that has an adjustment bar between the back and blade to adjustably regulate the thickness of sliced material.

2. Description of Prior Art

The so-called bow knife, named for its configurational similarity to the ordinary fiddle bow, has long been known as a slicing tool, especially for the creation of slices of similar thickness of various food products such as bread, cheese, sausage and the like. This type of knife provides a rigid back having spaced cooperating blade support posts extending therefrom to carry a perpendicularly orientated blade spacedly distant from the back so that a portion of material to be sliced will extend between the rigid back and the blade to regulate the thickness of that sliced material. In their early history bow knives traditionally had a handle for manipulation extending from the rearward end portion of the knife body parallel to the back, and the knife provided no means to adjust the distant between the back and knife blade to provide adjustable determination of the thickness of material to be sliced.

Through their developmental history bow knives have been improved until in the present day they are sophisticated and embody modern materials and manufacturing processes that increase their overall utility. One particular improvement of substantial importance has been the provision of some adjustment means to allow the slicing of material of adjustably predetermined thickness. The instant invention provides a new and novel member of this type of knife.

Bow knives or knives of a similar nature that have provided adjustment means to allow cutting of slices of variable thickness have generally provided some type of adjustable interconnection between the cutting blade and knife back so that the two elements may be moved relative to each other to regulate the distance therebetween and correspondingly the thickness of cut material. Since in this type of knife there must be a supportative interconnection with the knife body at each end of the blade, the structure necessarily requires at least two spaced adjustably movable blade mounting structures. The support between the blade and the knife body must be fairly rigid and usually somewhat tensive to allow the blade to provide its cutting action, so the support structures between body and blade must provide a movable joint that has the necessary support. Since these joints must also allow motion, normally of a sliding or screw type, the fastening structures tend to bind if the relationship between the knife body and blade does not remain substantially parallel during blade adjustment. This requirement has caused problems with prior adjustable knives because it often is difficult to adjust the spacing between the knife body and blade by normal manual means while maintaining the necessary parallel orientation of the elements so that articulately interconnecting structures do not skew and bind.

When a bow knife is used it commonly is moved in a lineally reciprocating fashion to accomplish cutting, and this is especially true if the knife has a crenate type blade which is common in modern bow knives. If the knife is to effectively move in a reciprocating fashion when cutting, the blade and back must be substantially parallel to each other with a constant distance therebetween to allow the knife to pass back and forth over a slice of material being cut, as a wedge shaped slot between the blade and back will not allow reciprocating motion but rather would cause the knife to bind on the sliced material. If softer food-type materials that are commonly sliced with bow knives are being sliced, it is difficult if not impossible to accomplish cutting by merely exerting downward force on the knife structure without some linear motion, since materials such as bread, cheese, sausage or the like are generally not rigid or homogenous enough to be cut only by direct pressure. Cutting without lineal motion would also do away with the benefits provided by the relatively thin crenate type blades that are popular in modern knives. This functional requirement dictates that an adjustable type bow knife must maintain parallelism of a substantial degree between the back and blade.

Most adjustable bow knives have attempted to maintain parallelism of blade and back by spaced blade mounting structures that have parts that are slidably or threadedly movable relative to each other by appropriate manual manipulation. Some few of such knives have provided an adjustment structure separate from the blade mounting structure, generally in a medial position between the movable knife connecting structures, but all such knives have had some type of mechanically constrained, articulating blade support structures that potentially may bind to prevent motion if the knife back and blade do not remain substantially parallel.

The instant knife differs from these prior adjustable bow knives by providing an intermediate adjustment bar between the knife back and blade that is supported at each end portion by pivotally mounted connecting arms that are parallel to each other and pivotally carried by the knife back so that the adjustment bar must maintain parallelism with the knife back and blade as it moves, but yet cannot be moved to cause binding in the movable connecting structures. This not only provides a simpler and more reliable adjustment structure, but also lowers the cost of manufacture and the ease and reliability of operation of such knives.

Since with the instant mounting structure the adjustment bar must of necessity move parallel to the knife back or blade and the structure has no spaced, mechanically restrained moving elements that can bind, adjustment means may be provided at any position along the adjustment bar. In the instant knife this allows an adjustment screw to be positioned between the handle and back of the knife body where it is readily accessible for manipulation. The adjustment screw carries an enlarged cylindrical nut with a peripheral portion extending laterally from the knife body for manipulation by the thumb of the hand of a user holding the knife by its handle in an orientation required for use. Additionally the adjustment screw pivotally communicates with the adjustment bar so that the screw may be angulated relative to the adjustment bar to allow more accurate and finer adjustment of the distance between the two elements than would a perpendicularly orientated screw of the same pitch.

While accomplishing these ends, the instant knife allows maintenance of the traditional shape of the historical bow knife. It also allows tensioning of a blade between its end supports since such tensioning does not effect the adjustment structures of the instant knife as it would in prior knives having movable knife mounting structures. Such blade tensioning allows the use of thinner blades and allows higher tension in those blades to more surely maintain their linearity to provide better cutting and reduced blade cost.

My invention resides not in any one of these features individually, but rather in the synergistic combination of all of the structures of my knife that necessarily give rise to the functions flowing therefrom, as herein specified and claimed.

SUMMARY OF INVENTION

The instant knife provides a bow body having an elongate back with blade support posts extending perpendicularly from each end portion and a handle extending in parallel orientation from the rearward end of the back. A blade is carried between the blade support posts spacedly distant from and parallel to the back with the blade cutting edge orientated perpendicularly to a plane through the bow body.

My adjustment structure provides an elongate adjustment bar carried between the knife back and blade for pivotal motion in the plane of the knife body parallel to the blade. The adjustment bar is carried by two support arms that are pivotally mounted at their first ends at spaced points along the adjustment bar and pivotally supported at their second ends on the adjacent portion of the back to extend in parallel relationship therefrom. An elongate adjustment screw extends through the body in the area of interconnection of the handle and back to pivotally interconnect with one end of the adjacent portion of the adjustment bar. The adjustment screw threadedly carries an enlarged cylindrical nut in its medial portion that extends laterally from the knife body for manipulation. The adjustment screw and nut provide frictional engagement with the body for positional maintenance once established in predetermined position.

In providing such a knife, it is:

A principal object to provide a traditionally configured bow knife that has adjustment structure allowing the cutting of slices of predetermined adjustably variable thickness.

A further object is to provide such a bow knife that has an adjustment bar carried between the knife back and blade by two parallel support arms pivotally mounted on the back and pivotally supporting the adjustment bar to create a parallelogram linkage that necessarily requires the adjustment bar to move parallel to the back and blade.

A further object is to provide such a knife that has an adjustment screw, extending in angulated orientation through the knife body in the area between the handle and back, that is pivotally interconnected with the adjustment bar and threadedly carries an enlarged nut extending from the knife body for manipulation to regulate position of the adjustment bar relative to the blade.

A still further object is to provide such a knife that is of new and novel design, of rugged and durable nature, of simple and economic manufacture and one otherwise well adapted to the uses and purposes for which it is intended.

Other and further objects of my invention will appear from the following specification and accompanying drawings which form a part hereof. In carrying out the objects of the invention, however, it is to be remembered that its accidental features are susceptible of change in design and structural arrangement with only one preferred and practical embodiment of the best known mode being illustrated and specified as required.

BRIEF DESCRIPTION OF DRAWINGS

In the accompanying drawings which form a part hereof and in which like numbers of reference refer to similar parts throughout.

DESCRIPTION OF PREFERRED EMBODIMENT

Figure 1:
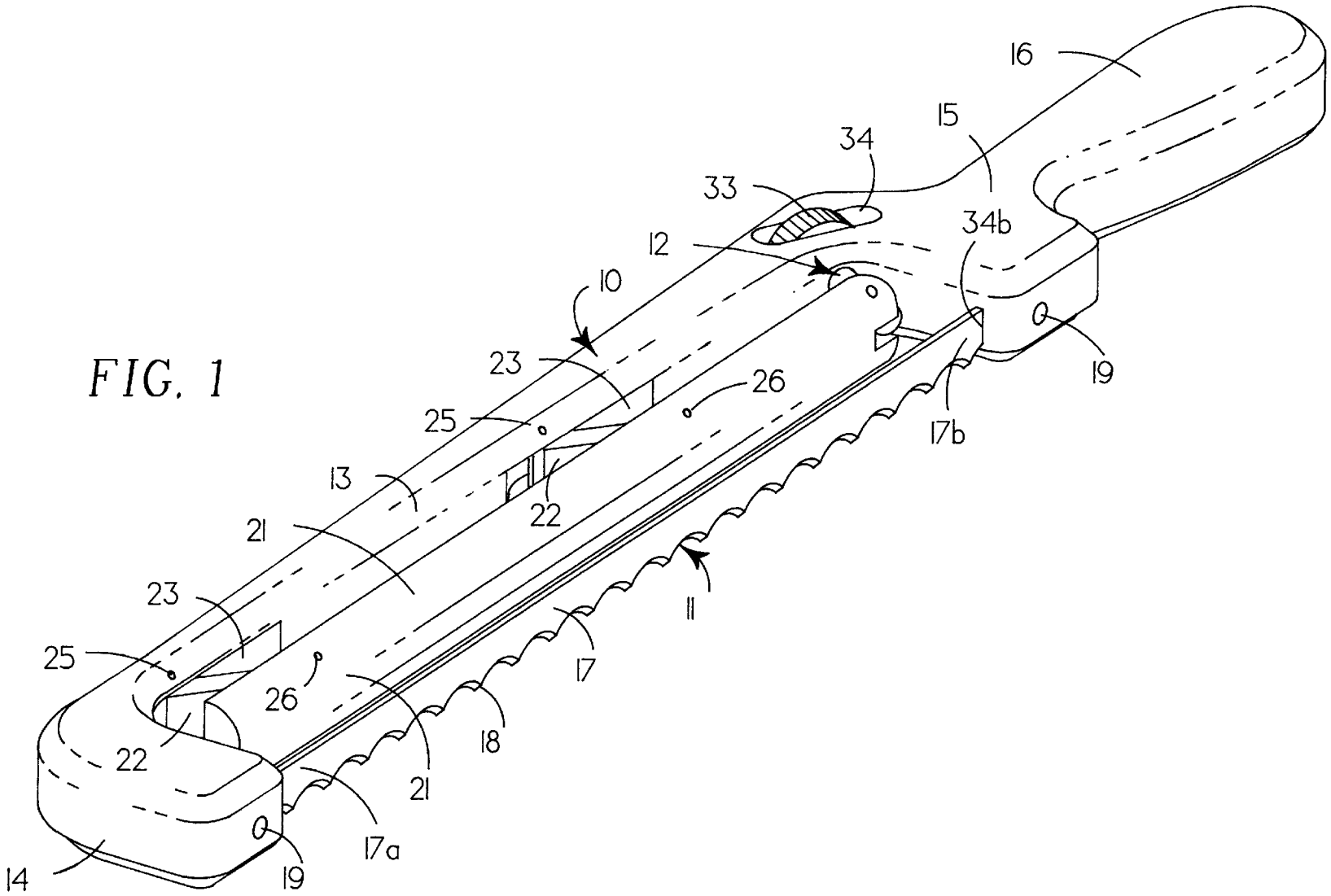
FIG. 1 is an isometric surface view of my knife showing its various parts, their configuration and relationship.
Figure 2:
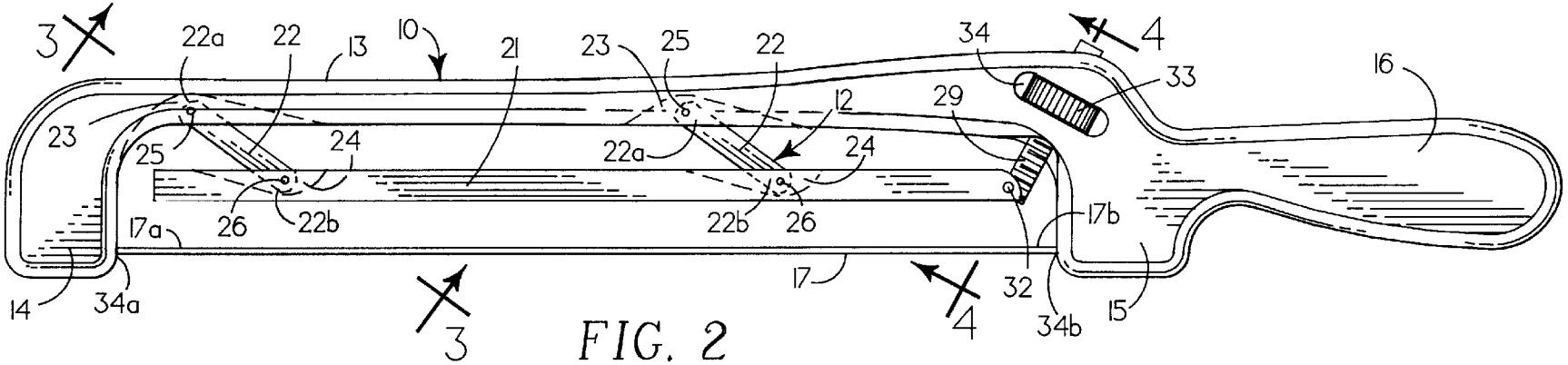
FIG. 2 is an orthographic top view of the knife of FIG. 1 with the adjustment bar shown in dashed outline in an alternate position.
Figure 3:
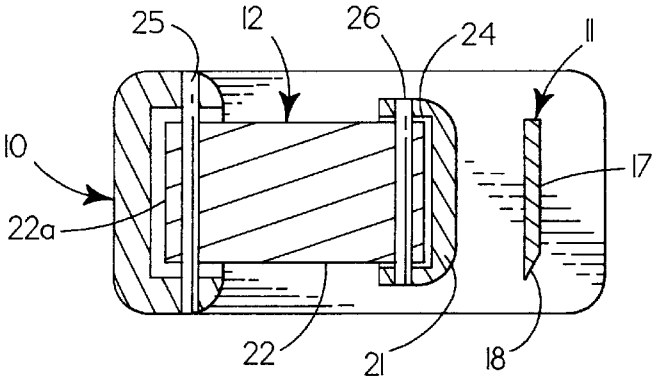
FIG. 3 is a somewhat enlarged vertical cross-sectional view through the knife of FIG. 2, taken on the line 3—3 thereon in the direction indicated by the arrows.
Figure 4:
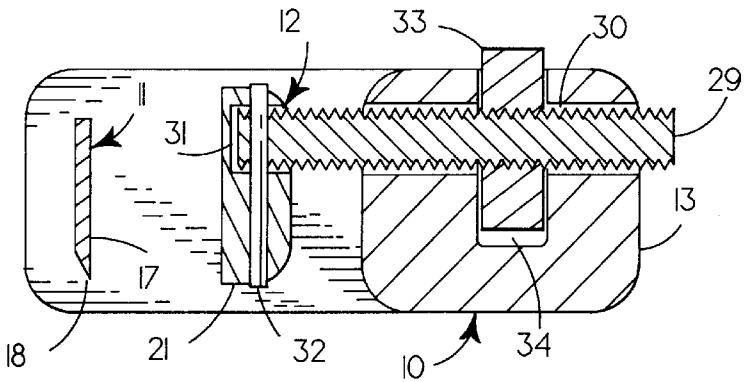
FIG. 4 is a somewhat enlarged vertical cross-sectional view through the knife of FIG. 2, taken on the line 4—4 thereon in the direction indicated by the arrows.

As seen in the accompanying drawings, the instant knife provides bow body 10 carrying blade 11, with adjustment structure 12 articulately carried between the body and blade to allow the cutting of slices of adjustably variable thickness.

Body 10 provides elongate back 13 with forward blade mounting post 14 extending perpendicularly from its first forward end portion and rearward blade mounting post 15 extending perpendicularly from its second rearward end portion. Handle 16 extends rearwardly from the rearward portion of back 13 and rear blade mounting post 15 to define the traditional bow knife body structure.

The body structure is formed of some rigid durable material, classically and in the instance illustrated of wood, but other materials having similar characteristics, especially such as polymeric or resinous plastics, are satisfactory. Since the knife normally is used in an environment associated with food, the material from which the body is formed should have appropriate physical and chemical characteristics for use in this environment, such as surfaces that are smooth and that may be easily cleaned, kept reasonably sterile and do not contaminate food stuff or allow excessive wear when used in normal operative fashion.

The shape of knife body 10 and especially the details of its external configuration are not essential to my invention and may vary so long as the essence of the U-shape is preserved. In general, most of the variant configurations of bow type knives that have heretofore become known may make use of my adjustment structure.

Since the length of extension of the blade mounting posts from the knife back limits the maximum thickness of a slice that can be cut and since the interposition of my adjustment structure between knife and back lessens this distance somewhat, this relationship must be considered in design of a particular knife, though dimensioning may vary widely to allow slices from the thinnest possible of one-sixteenth of an inch or less to several inches if desired. Commonly the desired variance of slice thickness is not greater than approximately one to two inches. The length of the knife back is not critical and may vary from an inch or two to several feet if desired, but the normal range of variance for practical utility is from about six inches for small knives to some ten to sixteen inches for general slicing and bread knives. The traditional handle for bow knives is of an elongate, bulbously curvilinear nature as illustrated, though it too may take various forms, such as a closed loop, an angulated orientation or the like. The handle structure may even be placed on the knife back in some position between or at the blade mounting posts, especially on the side extending away from the blade mounting post, or may even be non-existent as the knife can be manually manipulated by the back itself without use of a handle structure. All of these variant handle structures may be used in knives embodying my invention.

Blade 11 provides flat, relatively thin, elongate planar body 17 with integral cutting edge 18. The forward end portion 17*a* of the blade is carried by forward blade mounting post 14 and the rearward end portion 17*b* is carried by rearward blade mounting post 15. The interconnection of the blade ends in the respective blade mounting posts preferably is by means of elongate slots 34*a*, 34*b* defined in the adjacent facing surfaces of the blade mounting post to accept the blade ends and allow them to extend spacedly therein for fastening by pins 19 extending perpendicularly from the outer surface of the mounting posts inwardly through fastening holes (not shown) defined in the end portions of the blade and therepast. The blade is so oriented in the mounting posts as to extend perpendicularly to a plane through the body back and mounting posts and parallel to the surface of the back spacedly adjacent to the blade, as illustrated in FIG. 1.

The cutting edge 18 of the blade may be of any type that cuts semi-rigid, coherent food-like materials or other materials of the nature desired to be sliced. The blade of preference commonly is of the type illustrated with a cutting edge of crenate configuration that is sharpened on at least one side. This type of crenate blade when moved lineally has somewhat of a sawing action as well as a cutting action that aids the slicing of many food type materials. This crenate type blade structure is well known in the cutting arts and is not new or novel.

Such blades commonly are formed of stainless or titanium steel or some similar relatively expensive, hard knife blade material. Commonly for economy and to aid cutting such blades usually are relatively thin. These blades are well adaptable for use in bow knives because the blades may be tensioned to maintain their linear integrity and prevent bowing, bending or the like which would interfere with their cutting action. Commonly such blades maintain a sharpened edge and do not require resharpening over long periods of use, though the blade is accessible for sharpening if desired. The nature of the blade itself is not essential to my invention and thicker, straight knife edged blades, any of the various irregular jagged types of blades, saw type blades, round blades or others may be used in knives embodying my invention.

Adjustment structure 12 provides elongate adjustment bar 21 pivotally carried by similar spaced support arms 22 which are pivotally supported by the adjacent portion of back 13 so that the adjustment bar is carried into the space between the body back and blade 11. The adjustment bar 21 is relatively thin in its dimension perpendicular to the blade so as not to occupy excessive space between the knife back and blade, has a length somewhat less than the distance between adjacent surfaces of the blade mounting post 14, 15 to allow arcuate motion between the back and blade and has a straight linear surface with curved edges facing the slicing blade.

The outer end portions 22*a* of the support arms are carried in indentations 23 defined in the blade facing side of back 13, and the inner end portions 22*b* are carried in indentations 24 defined in the back facing portion of adjustment bar 21 to allow relative motion of the adjacent elements. The end portions of the support arms 22 are pivotally mounted in the indentations carrying them by pins 25 extending between the back and support arms and pins 26 extending between the adjustment bar and support arms both pins 25, 26 being arrayed parallel to the blade. The pins 25 are spaced at the same distance as the pins 26 so that the two support arms 22 extend parallel to each other so that when the adjustment bar 21 is moved toward or away from blade 11 it remains parallel thereto. The support arms 22 are of sufficient length that they will allow the adjustment bar 21 to move outwardly into immediate adjacency with blade 11.

Adjustment screw 29 is an elongate, headless threaded rod that is carried in adjustment screw hole 30 defined in the knife body 10 through the area of intersection of the back 13 and rearward blade mounting post 15, as illustrated. The adjustment screw hole 30 extends forwardly in angulated orientation with the back. The blade facing end of the adjustment screw extends into indentation 31 defined in the rearward end portion of the adjustment bar 21 and is there interconnected by pin 32 extending between the adjustment bar and adjustment screw to provide a pivotal interconnection.

Adjustment screw 29, in its medial portion carried in hole 30, threadedly carries cylindrical adjustment nut 33 having a knurled cylindrical surface to aid manual manipulation. This nut is carried in chamber 34 defined in the body structure and is of such size as to extend beyond the opposed surfaces of the body to provide access for manipulation. The adjustment nut 33 preferably is positioned in the body structure spacedly forwardly of handle 16 where it may be accessed by the thumb of a user so that the nut may be manipulated for adjustment while the knife is being held in an operative position.

The chambers 30, 34 defined in the knife body to carry the adjustment screw 29 and adjustment nut 33 preferably are so configured so as to provide a frictional fit for the adjustment elements therein to positionally maintain those elements once they are established in a particular position, but yet allow relatively easy manual manipulation of the elements. Resilient frictional bushing material (not shown) as known for such purposes may be interposed between the adjustment screw and nut and the cavities carrying them, and that construction is within the ambit and scope of my invention, though it has not been found necessary or particularly desirable.

Having described the structure of my knife, its function may be understood.

A knife is formed according to the foregoing specification and used for cutting essentially in the same fashion as prior bow knives. The knife is held in one hand by the handle 16, with a plane through the back 13 and blade mounting posts 14, 15 being substantially horizontal and the blade extending substantially vertically with the cutting edge 18 lowermost. In this orientation, the knife is moved with the adjustment bar 21 immediately adjacent to the end portion of material to be sliced (not shown) and the blade extending spacedly over that material. The knife then is lowered so that the cutting edge of the blade contacts the material to be sliced and simultaneously moved in a reciprocating fashion parallel to the adjustment bar while some downward pressure is applied and the blade facing edge of the adjustment bar is maintained on the outer surface of the material to be sliced. As this process proceeds, a cut will be initiated in the material and the severed material will pass upwardly through the space between the blade and the blade facing portion of the adjustment bar. The operation is continued until a slice is completely severed from the original material. Most materials can be cut with this type of knife if it be equipped with an appropriate blade, but most commonly it is used with a relatively thin crenate type blade for slicing of food materials such as bread, cheese, sausage, meat and the like or other similar materials having somewhat the same cohesiveness, firmness and texture.

To use my adjustment structure, adjustment nut 33 is rotated in the appropriate direction to cause the adjustment bar 21 to move toward or away from blade 11 so that the distance between the adjustment bar and blade becomes the desired thickness of a slice to be cut. As the adjustment nut is turned, it will move the adjustment screw 29 toward or away from the knife body, since the adjustment nut is positionally maintained in the knife body to cause corresponding motion of adjustment bar 21. The adjustment bar, by reason of its parallelogram type linkage with the knife body, must necessarily move to maintain parallelism between the adjustment bar and back so that the space between the bar and knife will allow the cutting of a slice of even thickness and the lineal motion of the knife during the cutting process. It is to be noted that in adjusting the instant knife there is no motion between relatively movable parts that could cause binding between those parts.

It is further to be noted that the adjustment of the distance between the adjustment bar and blade may be finely adjusted. Firstly, the threads on the adjustment screw may have a small pitch and secondly, the angularity of the adjustment screw relative to the knife body may be small to cause less motion than would result were the screw positioned at a greater angle or perpendicularly to the blade.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. An adjustable bow knife, comprising in combination:

a body having an elongate back having forward and rearward end portions opposed blade support arms extending spacedly, in parallel orientation from the back at each end portion, a blade carried between the opposed blade support arms parallel to an adjacent surface of the back and perpendicular to a plane through the support arms, and a handle extending rearwardly from the rearward portion of the back; and adjustment structure having an elongate adjustment bar having a linear edge facing the blade and pivotally carried between the back and the blade for parallel motion toward and away from the blade, by spaced support arms pivotally supported by the back to extend therefrom in spaced parallel array, an elongate adjustment screw extending through a first chamber defined in the body in forwardly angulating orientation to the adjustment bar and pivotally interconnected to the adjustment bar, and an adjustment nut threadedly engaged on the adjustment screw and carried in a second chamber defined in the body to extend from the body to allow access for manipulation to move the adjustment bar toward and away from the blade responsive to rotation of the adjustment nut.

2. A bow knife having a knife body with an elongate back, spaced cooperating blade support arms extending from the back and a blade carried between the blade support arms parallel to and spacedly distant from an adjacent surface of the back spacedly adjacent to the blade and extending perpendicularly to a plane through the back and the support arms, and an adjustment structure to allow cutting slices of variable thickness, comprising in combination:

an elongate adjustment bar, pivotally carried between the back and the blade by two spaced support arms that are pivotally supported in parallel array by the back for motion toward and away from the blade; and an adjustment screw carried in a first chamber defined in the body and extending through the body, with one end of the adjustment screw pivotally interconnected to the adjustment bar, and an adjustment nut threadedly engaged on the adjustment screw and carried in a second chamber defined in the body to extend from the knife body to allow manipulation to move the adjustment bar toward and away from the blade responsive to motion of the adjustment nut.

3. In a bow knife having a knife body with an elongate back with spaced cooperating blade supporting arms extending substantially perpendicularly from the end portions thereof to mount an elongate blade parallel to a surface of the back spacedly adjacent to the blade and perpendicular to a plane through the back and blade supporting arms, and a handle to aid manipulation carried by the knife body, an adjustment structure, comprising in combination:

an elongate adjustment bar carried between the blade and the back by two pivotally joined support arms pivotally supported in parallel array by the back of the knife body, and means for adjustably moving the adjustment bar relative to the knife blade in the space between the knife blade and the back to determine the thickness of material cut by the knife between the blade and the adjustment bar.

4. The bow knife of claim 3 wherein the means for adjustable moving the adjustment bar comprise an elongate adjustment screw carried in a first chamber defined in the knife body to extend in angulated orientation to pivotally interconnect the adjustment bar, and an adjustment nut threadedly engaged on the adjustment screw and carried in a second chamber defined in the knife body to project from the knife body to allow manipulation to move the adjustment bar toward and away from the knife blade responsive to rotation.

* * * * *